US009404471B2

(12) United States Patent
Ihsl

(10) Patent No.: US 9,404,471 B2
(45) Date of Patent: Aug. 2, 2016

(54) HYDRAULIC ENGINE INCLUDING HYDRAULIC POWER UNIT

(71) Applicant: Lucas Ihsl, Chungcheongnam-do (KR)

(72) Inventor: Lucas Ihsl, Chungcheongnam-do (KR)

( * ) Notice: Subject to any disclaimer, the term of this patent is extended or adjusted under 35 U.S.C. 154(b) by 363 days.

(21) Appl. No.: 14/057,862

(22) Filed: Oct. 18, 2013

(65) Prior Publication Data

US 2015/0107237 A1 Apr. 23, 2015

(51) Int. Cl.
*F15B 15/04* (2006.01)
*F15B 9/02* (2006.01)
*F03B 13/00* (2006.01)

(52) U.S. Cl.
CPC ..... *F03B 13/00* (2013.01); *F05B 2220/709* (2013.01)

(58) Field of Classification Search
CPC ..... F01D 15/08; F04B 17/003; F04B 43/08; F04B 43/088; F04B 43/095
USPC ..... 60/325, 413, 456
See application file for complete search history.

(56) References Cited

U.S. PATENT DOCUMENTS 3,598,506 A * 8/1971 O'Neill ..... F04B 43/10 310/328
3,902,318 A * 9/1975 Becker ..... B64C 13/40 60/388
4,495,965 A * 1/1985 Ise ..... F15B 13/02 137/601.19
4,808,874 A * 2/1989 Stahlhuth ..... H02N 2/043 310/328
6,071,088 A * 6/2000 Bishop ..... F04B 17/003 123/498
6,519,939 B1 * 2/2003 Duff ..... F15B 1/265 60/473
6,575,715 B1 * 6/2003 Rastegar ..... E04C 3/29 417/413.2
7,637,201 B2 * 12/2009 Lin ..... F15B 1/02 60/413
8,668,467 B2 * 3/2014 Douglas ..... F04B 35/045 417/223
2006/0245947 A1 11/2006 Seto et al.
2009/0311116 A1 * 12/2009 Bai ..... F04B 17/003 417/413.2
2013/0108428 A1 * 5/2013 Ihsl ..... F16D 33/02 415/203
2014/0017063 A1 * 1/2014 Ihsl ..... F04B 43/095 415/13

FOREIGN PATENT DOCUMENTS

CA 2614338 A1 * 5/2009 ..... B60K 8/00
DE 102006038957 B3 * 1/2008 ..... F01C 1/20
EP 1304488 A2 4/2003
EP 2587062 A1 5/2013
FR 550989 A * 3/1923 ..... F04B 43/08

* cited by examiner

*Primary Examiner* — Nathaniel Wiehe
*Assistant Examiner* — Matthew Wiblin
(74) *Attorney, Agent, or Firm* — Ladas & Parry LLP

(57) ABSTRACT

Provided is a hydraulic engine that generates power using oil pressure, the hydraulic engine including: a hydraulic power unit including a hydraulic tube comprising a hollow portion having an opened front end and being filled with a fluid, an amplitude amplification device that is disposed at the rear side of the hydraulic tube, an oscillator that is disposed at the rear side of the amplitude amplification device so as to be deformed and increases and decreases a pressure within the hydraulic tube, and an oscillator head that is attached to a front end of the oscillator.

15 Claims, 11 Drawing Sheets

HYDRAULIC ENGINE INCLUDING HYDRAULIC POWER UNIT

BACKGROUND

1. Field

One or more embodiments of the present invention relate to a hydraulic engine, and more particularly, to a hydraulic power unit that includes a ceramic oscillator and inpours and extrudes a fluid in association with the ceramic oscillator, and a hydraulic engine that includes the hydraulic power unit and generates rotatory power.

2. Description of the Related Art

In general, power (rotatory power) for driving vehicles, various machines, or mechanisms is obtained by burning a fossil fuel. When the fossil fuel is burned, a large amount of carbon dioxide is generated, and various harmful substances are mass-produced, which is a major cause of environmental pollution. In addition, it is widely known that there is a limitation in relying on fossil fuel because the amount of fossil fuel such as crude oil or coal which exists on earth is limited. For this reason, humans have tried to develop new energy sources and have conducted research into methods of effectively using existing energy sources.

Among the research results achieved so far, a method of obtaining power for a vehicle or a machine by using electrical energy obtained through battery charging, a method of burning existing fossil fuel, and a hybrid method using a battery have been developed. However, existing power generation apparatuses (engines) which utilize electrical energy have a performance limit. For this reason, there are increasing demands to develop new power generation apparatuses that do not generate carbon dioxide when used, use eco-friendly electrical energy, and have better performance and a long lifespan.

SUMMARY

One or more embodiments of the present invention include a new engine that generates rotatory power by using deformation energy of eco-friendly ceramics, the engine having improved performance and a long lifespan.

One or more embodiments of the present invention include a hydraulic power unit which is environmentally friendly, has a long lifespan, and may extrude a working fluid by using a strong force, which may be used in order to form a new engine.

Additional aspects will be set forth in part in the description which follows and, in part, will be apparent from the description, or may be learned by practice of the presented embodiments.

According to one or more embodiments of the present invention, a hydraulic engine includes a hydraulic power unit comprising a hydraulic tube comprising a hollow portion having an opened front end and being filled with a fluid, an amplitude amplification device that is disposed at the rear side of the hydraulic tube, an oscillator that is disposed at the rear side of the amplitude amplification device so as to be deformed and increases and decreases a pressure within the hydraulic tube, and an oscillator head that is attached to a front end of the oscillator. The hydraulic tube extends in a longitudinal direction, comprises a metal tube formed on the outside thereof and an elastic tube formed on the inside thereof, and is configured in the form of a double tube having an outer hollow and an inner hollow. The amplitude amplification device comprises a casing having a hollow formed therein, a swell tube that is disposed within the casing and has a cylindrical hollow therein, a plurality of vibration rods that are disposed in the hollow of the swell tube, and an elastic chip that is disposed in the hollow of the swell tube, intersects with the hollow, and is disposed between the plurality of vibration rods. The oscillator moves bidirectionally and changes a pressure within the hydraulic tube by applying deformation force to the vibration rod according to its deformation so that a fluid within the hydraulic tube is extruded to the outside or flows into the hydraulic tube.

The oscillator may be deformed in a direction toward the inside of the hollow portion of the hydraulic tube and in an opposite direction when electricity is applied thereto by an inverse piezoelectric effect.

The hydraulic tube may include a front position fixation holder and a rear position fixation holder that is disposed within the metal tube and comes into contact with a front side and a rear side of the elastic tube, and a connection jig that is disposed at a front end of the metal tube and is disposed so as to come into contact with the front side of the position fixation holder of the elastic tube. The position fixation holder may be disposed so as to come into contact via a seal ring with at least one vibration rod included in the amplitude amplification device. At least a portion of the connection jig seals the outer hollow. An opening may be formed in at least a portion of the connection jig so as to cause the inner hollow and the outside to communicate with each other. A side through hole may be formed at one side of the metal tube so as to cause the outer hollow and the outside to communicate with each other.

The hydraulic tube may include a plurality of first elastic links. The elastic tube may be formed as a corrugated pipe having a plurality of corrugations extending in a longitudinal direction. The first elastic link may be disposed so as to come into contact with a concave portion of the corrugation and to extend in a longitudinal direction along the corrugation. One end of the first elastic link may come into contact with the connection jig through the front position fixation holder, the other end thereof may come into contact with the vibration rod through the position fixation holder, and the elastic tube may be pressed in a horizontal direction according to a deformation force of the vibration rod.

The first elastic link may be formed by bending an elongated steel wire. The first elastic link may include first curved portions, which are both sides of the steel wire being bent inwards in a longitudinal direction, and second curved portions, which are both ends of the steel wire being bent and gathered together toward the center through the first curved portions. The second curved portion may have a ring shape.

A lower portion of the second curved portion may come into contact with at least a portion between the first curved portions.

The elastic chip may be formed of a material having an elastic restoring force, the elastic chip having a form of a circular plate with a protruding central portion, and may be provided with a plurality of holes formed along a circumference thereof.

The holes may be formed in a fan shape with a portion of the circumference of the elastic chip forming an arc thereof.

The swell tube may include a plurality of second elastic links that are disposed along a circumferential surface of the vibration rod.

The second elastic link may be formed by bending an elongated steel wire. The second elastic link comprises first curved portions, which are both sides of the steel wire being bent inwards in a longitudinal direction, and second curved portions, which are both ends of the steel wire being bent and gathered together toward the center through the first curved portions. The second curved portion may have a ring shape.

The lower portion of the second curved portion may come into contact with at least a portion between the first curved portions.

The elastic chip may be disposed at a position overlapping a position at which the second curved portion is disposed.

According to one or more embodiments of the present invention, a hydraulic engine includes the hydraulic power unit; a housing; a rotor that is rotatably supported within the housing and has a rotor blade disposed on the circumference thereof; and a flange that is disposed within the housing. The flange comprises a front flange and a rear flange, and a rotor is disposed between the front flange and the rear flange. The rear flange comprises a fixation hole for fixing the hydraulic power unit and an extrusion hole. The extrusion passage is configured to cause the rotor blade of the rotor and an inner hollow of a hydraulic tube included in the hydraulic power unit to communicate with each other. The front flange comprises a fluid chamber and a discharge hole so that a fluid inpoured through the rotor blade is bidirectionally discharged.

The extrusion passage may have a tilt angle with respect to the rotor blade so that the fluid extruded from the hydraulic tube applies an extrusion force to the rotor blade to thereby rotate the rotor.

The fluid chamber and the discharge hole formed in front of the front flange and a side through hole formed in a metal tube of the hydraulic tube may be connected to each other so that the fluid flows therebetween.

The hydraulic engine may further include an operational module that drives the hydraulic power unit, adjusts a number of rotations and torque of the rotor, and comprises a secondary battery as a driving power source.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
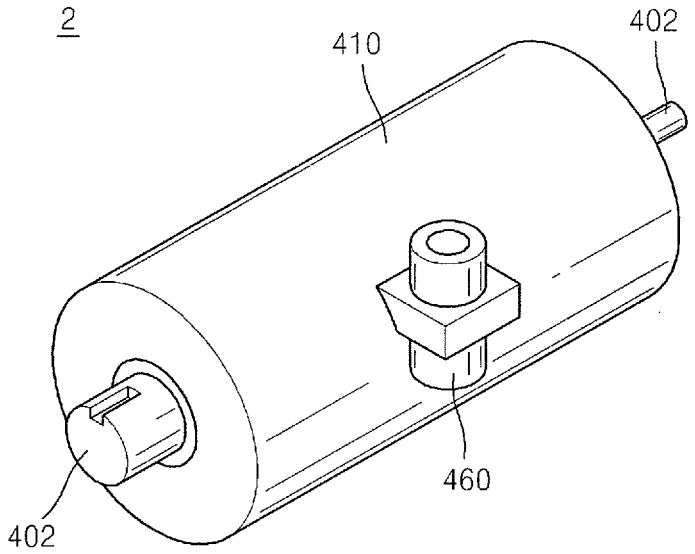
FIG. 1 is a diagram illustrating a contour of a hydraulic engine according to an embodiment of the present invention.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description. Expressions such as "at least one of," when preceding a list of elements, modify the entire list of elements and do not modify the individual elements of the list.

Figure 2:
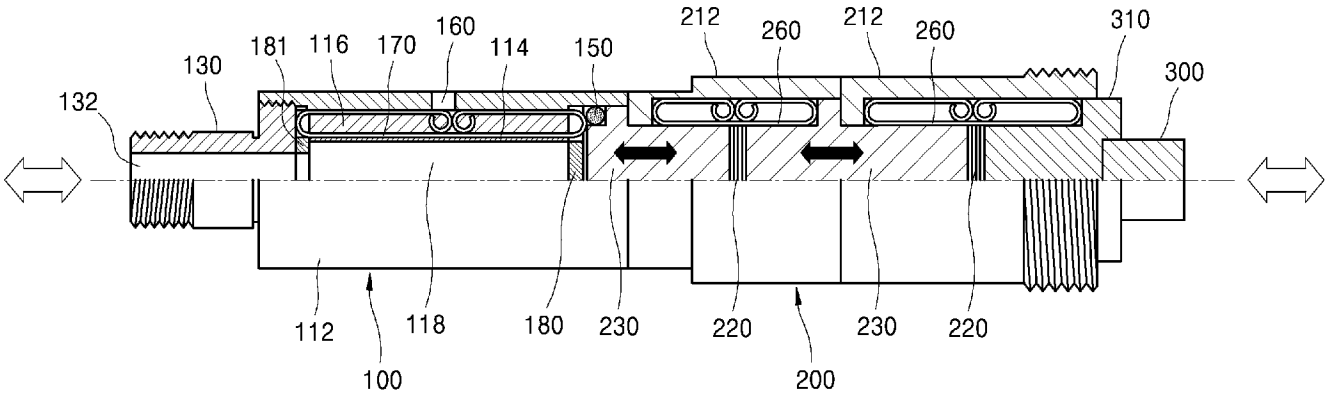
FIG. 2 is a diagram illustrating a structure of a hydraulic power unit included in the hydraulic engine according to the embodiment of the present invention.
Figure 3:
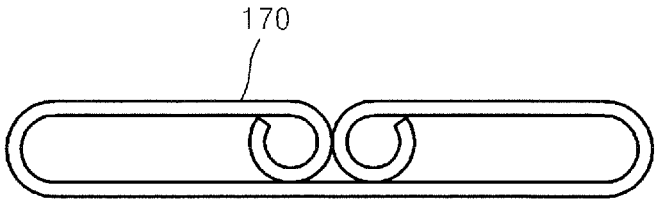
FIG. 3 is a diagram illustrating first and second elastic links included in a hydraulic tube and an amplification device of the hydraulic engine according to the embodiment of the present invention.
Figure 4:
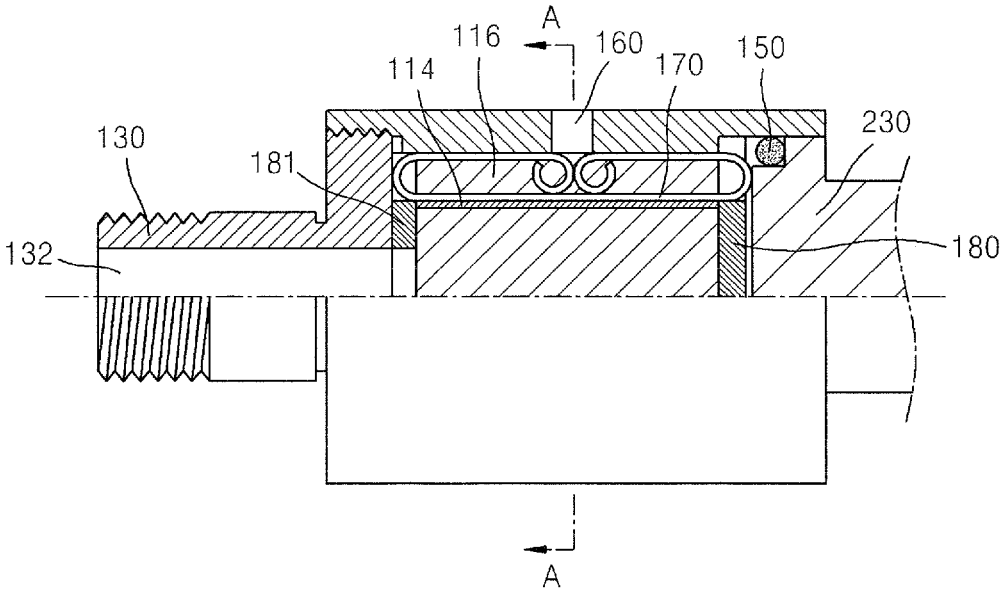
FIG. 4 is a diagram illustrating a structure of the hydraulic tube of the hydraulic engine according to the embodiment of the present invention.
Figure 5:
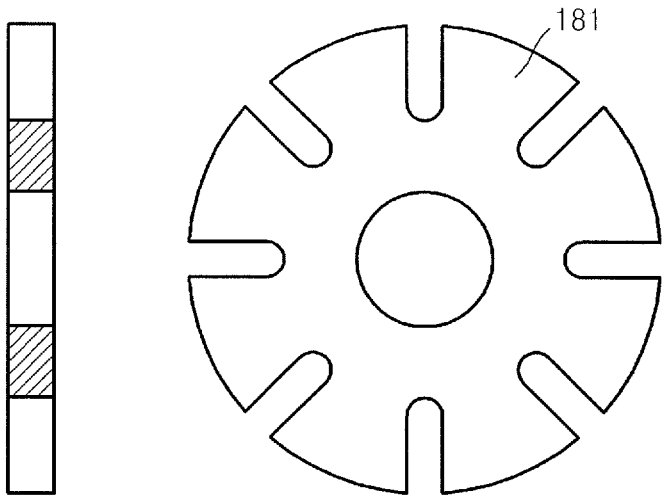
FIG. 5 is a diagram illustrating a front position fixation holder.

FIG. 1 is a diagram illustrating a hydraulic engine according to an embodiment of the present invention. FIG. 2 is a diagram illustrating a structure of a hydraulic power unit included in the hydraulic engine according to the embodiment of the present invention. FIG. 3 is a diagram illustrating first and second elastic links included in a hydraulic tube and an amplification device of the hydraulic engine according to the embodiment of the present invention. FIG. 4 is a diagram illustrating a structure of the hydraulic tube of the hydraulic engine according to the embodiment of the present invention. FIG. 5 is a diagram illustrating a front position fixation holder.

Figure 6:
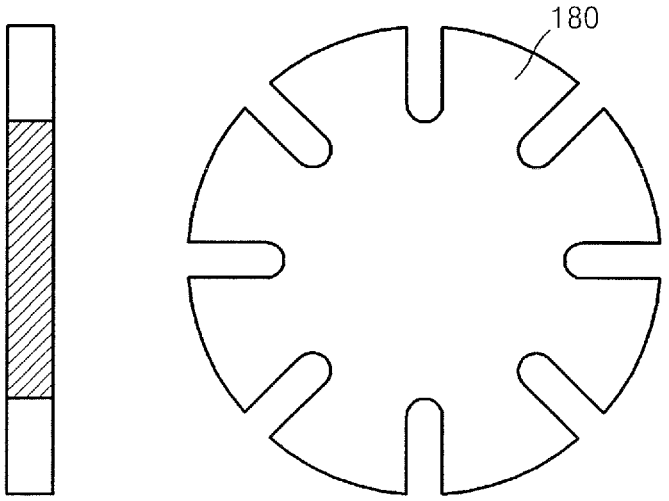
FIG. 6 is a diagram illustrating a rear position fixation holder.
Figure 7:
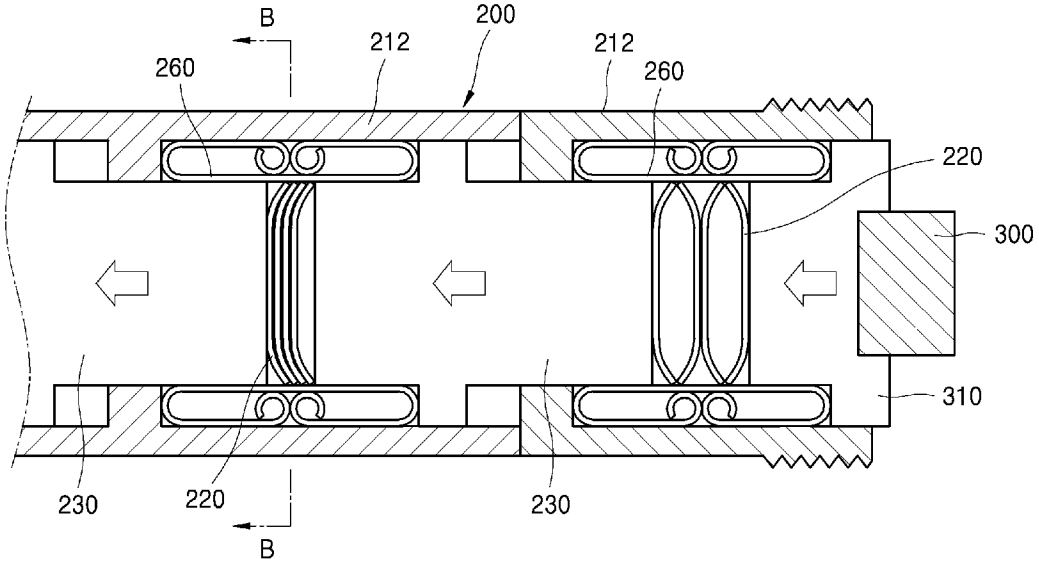
FIG. 7 is a diagram illustrating a structure of an amplitude amplification device of the hydraulic engine according to the embodiment of the present invention.
Figure 8:
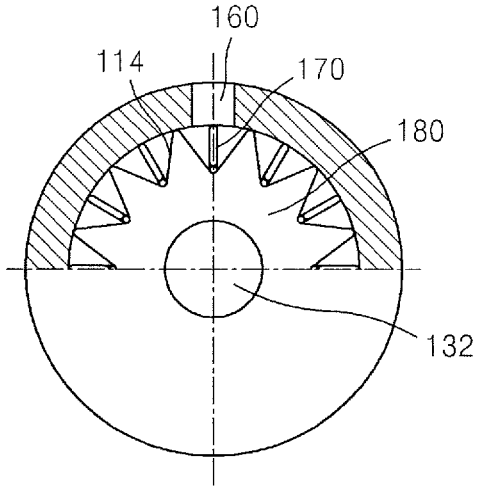
FIG. 8 is a cross-sectional view taken along a line A-A of FIG. 4.
Figure 9:
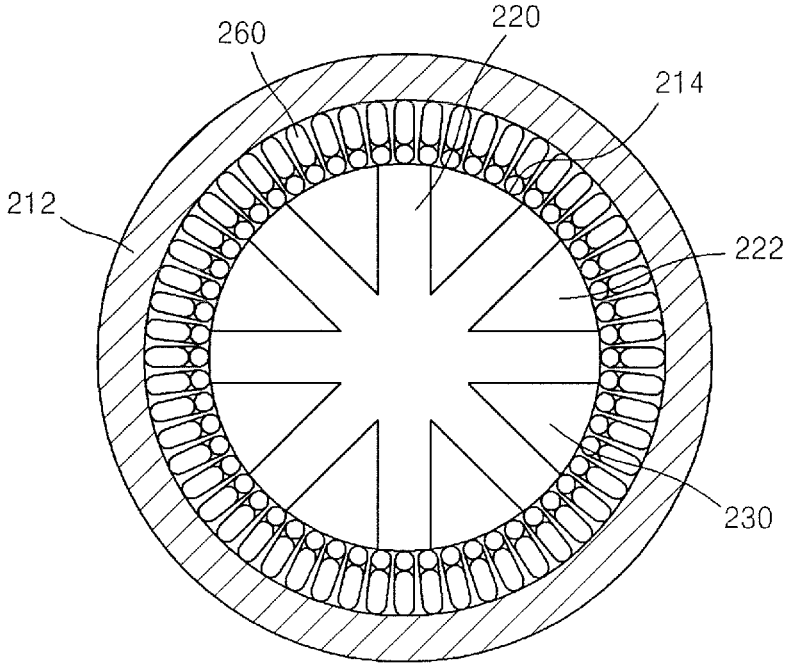
FIG. 9 is a cross-sectional view taken along a line B-B of FIG. 7.
Figure 10:
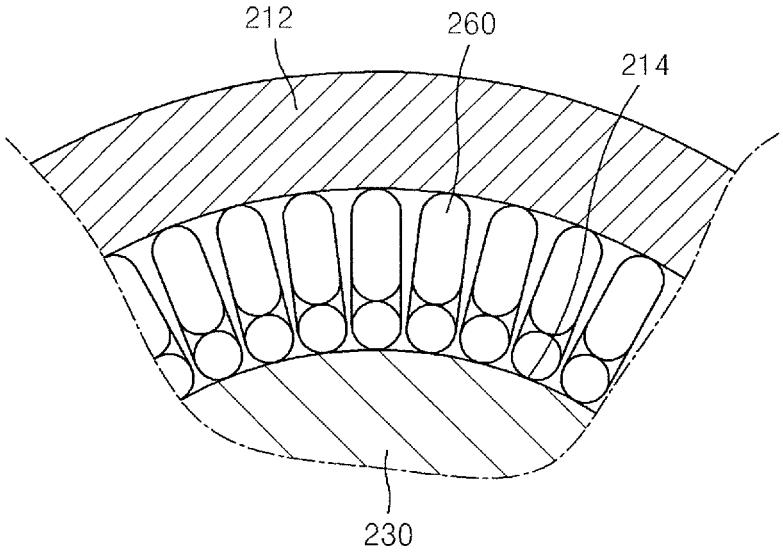
FIG. 10 is a diagram illustrating a structure of a portion of the amplitude amplification device of the hydraulic engine according to the embodiment of the present invention.

FIG. 6 is a diagram illustrating a rear position fixation holder. FIG. 7 is a a diagram illustrating a structure of an amplitude amplification device of the hydraulic engine according to the embodiment of the present invention. FIG. 8 is a cross-sectional view taken along a line A-A of FIG. 4. FIG. 9 is a cross-sectional view taken along a line B-B of FIG. 7. FIG. 10 is a diagram illustrating a structure of a portion of the amplitude amplification device of the hydraulic engine according to the embodiment of the present invention.

Hereinafter, a hydraulic power unit 1 of a hydraulic engine according to the present invention will be described.

The hydraulic power unit 1 according to the present invention includes a hydraulic tube 100 that has a hollow portion that has an opened front end and is filled with a fluid, an amplitude amplification device 200 that is disposed at the rear side of the hydraulic tube 100, and an oscillator 300 that is disposed at the rear side of the amplitude amplification device 200 so as to be deformed and increases and decreases a pressure within the hydraulic tube 100.

The hydraulic tube 100 extends in a longitudinal direction. The hydraulic tube 100 includes a metal tube 112 formed on the outside thereof and an elastic tube 114 formed on the inside thereof, and is configured in the form of a double tube having an outer hollow 116 and an inner hollow 118.

The amplitude amplification device 200 includes a plurality of casings 212 having a hollow formed therein, a plurality of swell tubes 214 that are respectively disposed within the casings 212 and have a cylindrical hollow therein, a plurality of vibration rods 230 that are respectively disposed in the hollows of the swell tubes 214, and a plurality of elastic chips 220 that are respectively disposed in the hollows of the swell tubes 214, intersect with the hollows, and are disposed between the vibration rods 230.

The oscillator 300 is configured to move bidirectionally and changes a pressure of fluid within the hydraulic tube 100 by applying a deformation force to the vibration rod 230 according to its deformation so that the fluid within the hydraulic tube 100 is extruded to the outside or flows into the hydraulic tube 100.

Hereinafter, the hydraulic tube 100 will be described.

The hydraulic tube 100 is a tube type structure having a hollow that extends in a longitudinal direction and is filled with a working fluid.

Specifically, the hydraulic tube 100 is formed in the form of a double tube including the metal tube 112 formed on the outside thereof and the elastic tube 114 formed on the inside thereof and has the outer hollow 116 and the inner hollow 118. That is, the elastic tube 114 is disposed within the metal tube 112, and thus, the hydraulic tube 100 has a double tube structure in which the inner hollow 118 is formed within the elastic tube 114, the outer hollow 116 is formed between the elastic tube 114 and the metal tube 112, and the inner hollow 118 is formed within the outer hollow 116.

The metal tube 112 is formed of a metal material, and the elastic tube 114 is formed of a metal or an elastic material. The elastic tube 114 may be formed of a material having an elastic restoring force, for example, a metal, plastic, or rubber.

Hereinafter, the amplitude amplification device 200 will be described.

The amplitude amplification device 200 is disposed at the rear side of the hydraulic tube 100. The amplitude amplification device 200 includes the plurality of casings 212 having a hollow formed therein, the plurality of swell tubes 214 that are respectively disposed within the casings 212 and have a cylindrical hollow therein, the plurality of vibration rods 230 that are respectively disposed in the hollows of the swell tubes 214, and the plurality of elastic chips 220 that are respectively disposed in the hollows of the swell tubes 214, intersect with the hollows, and are disposed between the vibration rods 230.

The plurality of casings 212 are configured as a housing of the amplitude amplification device 200, and may have a cylindrical shape having a hollow formed therein.

The swell tube 214 is disposed within the casing 212, and may have a cylindrical shape having a hollow formed therein in a similar manner to the casing 212.

The swell tube 214 may have a structure in which a plurality of second elastic links 260 are arrayed in the form of a cylinder. That is, the plurality of second elastic links 260 extend in a longitudinal direction are disposed in a circumferential direction so as to form a cylindrical tube, thereby completing the swell tube 214. The second elastic link 260 will be described below in detail.

The vibration rod 230 is disposed within the swell tube 214. The vibration rod 230 is a member having a configuration of a cylindrical beam and is disposed within the swell tube 214. At least one vibration rod 230 is disposed within the swell tube 214.

Meanwhile, a spool or a plunger may be provided at the front end of the vibration rod 230, but the present invention is not limited thereto.

As illustrated in FIG. 7, the plurality of elastic chips 220 are disposed within the swell tube 214, and each of the elastic chips 220 is has a circular plate for before deformation and crosses the hollow of the swell tube 214. The elastic chip 220 is disposed within the swell tube 214 so as to come into contact with the vibration rod 230. The elastic chip 220 includes a plurality of holes 222 formed along a circumference thereof. Meanwhile, as illustrated in FIG. 9, the holes 222 are radially disposed, and may be formed in a fan shape with an inner side of the hollow forming an arc thereof.

In addition, the elastic chip 220 is formed of a material having an elastic restoring force, and may be a Belleville spring that is formed of, for example, a metal. Meanwhile, for example, the elastic chip 220 may have a shape with a protruding center portion. Thus, the elastic chip 220 is deformed in accordance with an increase or decrease in an external force or the presence or absence of an external force. For example, the elastic chip 220 may be deformed from a flat shape before the deformation to a curved shape in accordance with the application of an external force. The elastic chip 220 is formed of an elastic material, and thus, has a restoring force according to its deformation.

Meanwhile, the elastic chip 220 is disposed to come into contact with the vibration rod 230 and the oscillator head 310 and to receive a pressing force from the oscillator head 310. Accordingly, the elastic chip 220 maintains its flat shape in an initial state when an external force is not applied thereto. Subsequently, when an external force is applied to the elastic chip 220 from the oscillator 300, the elastic chip 220 is deformed into a curved shape according to its restoring force.

Hereinafter, the oscillator 300 will be described.

The oscillator 300 is disposed at the rear end of the hydraulic power unit 1, and may be deformed in a longitudinal direction of the hydraulic power unit 1. The oscillator 300 is constituted by a piezoelectric element, and is preferably formed as a stack including piezoelectric elements. Meanwhile, the oscillator head 310 that transmits a force according to the deformation of the oscillator 300 may be disposed at a tip of the oscillator 300. At this time, the oscillator head 310 is partially inserted into the swell tube 214 so as to come into contact with the elastic chip 220. Thus, the elastic chip 220 may be disposed between the oscillator head 310 and the vibration rod 230 to thereby receive a pressing force from both the oscillator head 310 and the vibration rod 230. In addition, a connecting device may be disposed in an operational module for driving the oscillator 300.

Meanwhile, the hydraulic engine 2 may further include an operational module (not shown) that drives the hydraulic power unit 1 by applying an operational signal to the oscillator 300, adjusts a number of rotations and a torque of the rotor, and includes a secondary battery as a driving power source.

The hydraulic engine 2 may further include an oscillator housing 414 so as to surround the oscillator 300. The oscillator housing 414 may be filled with an insulation oil so as to reduce the temperature of the oscillator 300 which increases due to the operation of the oscillator 300. The oscillator housing 414 may include an opened hole 416 through which the insulation oil within the oscillator housing 414 flows and a predetermined pipe so as to move the insulation oil. The pipe may communicate with a predetermined cooling unit. The cooling unit includes a predetermined pipe structure and a cooling device, and prevents the temperature of the oscillator 300 from excessively increasing, thereby preventing a reduction of the operational efficiency of the hydraulic power unit 1 and a hydraulic engine 2 according to the present invention.

Preferably, the oscillator 300 is deformed when electricity is applied thereto by an inverse piezoelectric effect, and is deformed in a direction toward the inside of the hollow portion of the hydraulic tube 100 and in a direction opposite thereto.

Hereinafter, more detailed configurations and a connection structure of components constituting the hydraulic power unit 1 will be described.

Preferably, the hydraulic tube 100 includes position fixation holders 180 and 181, which are disposed within the metal tube 112 and respectively come into contact with the front side and the rear side of the elastic tube 114, and a connection jig 130 that is disposed at a front end of the metal tube 112 and at the same time in front of the front position fixation holder 181 coming into contact with the front side of the elastic tube 114.

The connection jig 130 may be a member that is disposed to fix the hydraulic power unit 1 to the hydraulic engine 2 when configuring the hydraulic engine 2 by using the hydraulic power unit 1. For example, the connection jig 130 may have a pipe shape having a male screw portion formed on the outside thereof and having an opening 132 therein.

At least a portion of the connection jig 130 seals the outer hollow 116, and the opening 132 may be formed in at least a portion of the connection jig 130 so that the inner hollow 118 communicates with the outside.

That is, as illustrated in FIG. 2, the connection jig 130 is configured in such a manner that a portion thereof extends in a circumferential direction. The extended portion seals a front end of the outer hollow 116 formed between the metal tube 112 and the elastic tube 114 so as to block the communication between the outer hollow 116 and the inner hollow 118. In addition, the opening 132 is formed in a center portion of the connection jig 130 so that the inner hollow 118 formed by the elastic tube 114 communicates with the outside.

Meanwhile, a side through hole 160 is formed at one side of the metal tube 112 so that the outer hollow 116 communicates with the outside. The movement of a fluid through the side through hole 160 will be described below.

The position fixation holders 180 and 181 are respectively disposed at the front side and the rear side of the hydraulic tube 100. In addition, the position fixation holders 180 and 181 are disposed within the metal tube 112 so as to respectively come into contact with the front and rear sides of the elastic tube 114. That is, the elastic tube 114 is disposed between the position fixation holders 180 and 181 and the connection jig 130, and the movement of a fluid between the outer hollow 116 and the inner hollow 118 may be blocked by the position fixation holders 180 and 181 and the connection jig 130.

The position fixation holder 180 is disposed to come into contact through a seal ring 150 with at least one vibration rod 230, which is included in the amplitude amplification device 200. The position fixation holder 180 may transmit a deformation force according to the vibration rod 230 to a fluid within the hydraulic tube 100 through the elastic link 170.

The elastic tube 114 is formed as a corrugated pipe having a plurality of corrugations extending in a longitudinal direction, and thus, a cross-section of the elastic tube 114 in a horizontal direction may have such a shape with alternating concave portions and convex portions. For example, as illustrated in FIG. 8, the cross-section of the elastic tube 114 may have a star shape in which a plurality of convex portions and a plurality of concave portions are formed in a circumferential direction.

The elastic link 170 is disposed in the concave portion of the elastic tube 114.

The elastic link 170 is formed of a material having stiffness and elasticity like an elongated steel wire.

The elastic link 170 is formed by bending an elongated straight steel wire. For example, the elastic link 170 is formed by bending both ends of the steel wire inwards in a longitudinal direction as illustrated in FIG. 3 and then by bending the both ends gathered together toward the center, and thus, the elastic link 170 has a ring shape. Thus, the elastic link 170 may include first curved portions formed at both ends and second curved portions formed to come into contact with each other on the inner side. Meanwhile, an elongated straight portion is formed between the curved portions.

The second curved portion is bent in the form of a ring, and may be preferably configured such that a lower portion of the ring comes into contact with the straight portion below the ring. That is, the lower portion of the second curved portion may come into contact with at least a portion between the first curved portions.

Thus, when the both ends of the elastic link 170 are pressed in a state where the upward deformation of the elastic link 170 is limited, the elastic link 170 may be deformed in such a manner that the second curved portions having a ring shape are gathered together on the inner side and press the straight portion below the second curved portions so as to be bent downwards.

The elastic link 170 is a member having a configuration and arrangement as presented above, and it should be understood that the elastic link 170 is not a member for connecting other members.

Meanwhile, the predetermined position fixation holders 180 and 181 may be provided so as to appropriately position the elastic link 170 within the hydraulic tube. The position fixation holders 180 and 181 are provided at both ends of the elastic link 170 and the elastic tube 114. As illustrated in FIG. 4, a predetermined step height formed in the inner surface of the of connection jig 130 may function as the position fixation holder 181.

That is, the elastic link 170 is disposed in front of the vibration rod 230 so as to be interposed between the connection jig 130 and position fixation holders 180 and 181. Thus, as described above, when a deformation force is applied the elastic link 170 through the vibration rod 230, the elastic link 170 is deformed in a direction of an inner diameter, and thus, the elastic link 170 presses the elastic tube 114, thereby changing a pressure of a fluid within the elastic tube 114.

The elastic link 170 according to the current embodiment may be more stably fixed between the connection jig 130 and the position fixation holders 180 and 181, and the second curved portions bent in the form of a ring come into contact with the straight portion disposed below the second curved portions. Thus, the elastic link 170 may be more stably deformed in the direction of the inner diameter due to the deformation force in both lateral directions. Accordingly, the fluid within the hydraulic tube 100 may be more smoothly extruded or inpoured.

That is, when the elastic link 170 is compressed by the vibration rod 230 in a longitudinal direction, the second curved portions are pressed inwards against each other, and thus, the second curved portions press the straight portion, which is disposed below the second curved portions, downwards. Thus, when the vibration rod 230 presses the elastic link 170, the straight portion is prevented from being deformed upwards and is pressed downwards due to the pressure of the second curved portions to thereby be deformed. In addition, the vibration rod 230 presses the elastic link 170 so that the elastic tube 114 is deformed inwards.

FIGS. 9 and 10 illustrate the amplitude amplification device 200.

The amplitude amplification device 200 according to the current embodiment includes the plurality of casings 212 having a hollow formed therein, the plurality of second elastic links 260 that are respectively disposed in the hollows of the casings 212 so as to constitute a tube, the plurality of vibration rods 230 that are disposed in the tube constituted by the elastic links, and the plurality of elastic chips 220 that are respectively disposed in the hollows of the swell tubes 214 so as to intersect with the hollows.

The casing 212, the vibration rod 230, and the elastic chip 220 are as described above. Herein, a detailed configuration of the swell tube 214 will be described.

The second elastic link 260 constituting the swell tube 214 has a similar structure to the elastic link 170 which is described with respect to the hydraulic tube 100. That is, the second elastic link 260 is formed by bending an elongated steel wire. For example, the elastic link 170 is formed by bending both ends of the steel wire inwards in a longitudinal direction as illustrated in FIG. 3 and then by bending the both ends gathered together toward the center, and thus the second elastic link 260 has a ring shape. Thus, the elastic link 170 may include first curved portions formed at both ends and second curved portions formed to come into contact with each other on the inner side. Meanwhile, an elongated straight portion is formed between the curved portions.

The second curved portion is bent in the form of a ring, and may be preferably configured such that a lower portion of the ring comes into contact with the straight portion below the ring. Thus, when the both ends of the second elastic link 260 are pressed in a state where the upward deformation of the second elastic link 260 is limited, the second elastic link 260 may be deformed in such a manner that the second curved portions having a ring shape are gathered together on the inner side and press the straight portion below the second curved portions so as to be bent downwards.

Meanwhile, the elastic chip 220 may be disposed to cover the second curved portions. That is, as illustrated in FIG. 9, the elastic chip 220 may be disposed in a portion where the second curved portions are gathered together on the inner side. Thus, a deformation due to pressing may be concentrated on the elastic chip 220 which is disposed at a position where the second curved portions are disposed.

The second elastic links 260 are arranged in a circumferential direction so as to constitute a tube. That is, the plurality of second elastic links 260 are disposed centering around the vibration rod 230 in the circumferential direction of the vibration rod 230, and thus, the plurality of elastic links 260 may form a hollow in a direction of an inner diameter.

At this time, in order to appropriately fix the second elastic link 260, the casing 212 may have a predetermined step height, but the present invention is not limited thereto.

As described above, when the second elastic link 260 receives a deformation force in a direction of an inner diameter by a vibration force of the oscillator 300, the second elastic link 260 may be deformed in the direction of the inner diameter to thereby press the elastic chip 220, and thus, the elastic chip 220 may deform.

The second elastic link 260 according to the current embodiment may be more stably fixed within the casing 212, and the second curved portions bent in the form of a ring come into contact with the straight portion disposed below the second curved portions. Thus, the second elastic link 260 may be more stably deformed in the direction of the inner diameter due to the deformation force in both lateral directions. Accordingly, the second elastic link 260 may be more stably deformed, and the hydraulic power unit may reliably operate.

Hereinafter, an operation of the hydraulic power unit 1 will be described.

First, an operation of the amplitude amplification device 200 will be described below.

As illustrated in FIG. 7, when an external force is applied to the elastic chip 220 from the oscillator 300, the elastic chip 220 is deformed into a curved shape with a protruding center portion. The elastic chip 220 may be repeatedly deformed and restored to the original shape according to the external force applied from the oscillator 300 disposed below the hydraulic power unit 1.

For example, when the oscillator 300 is deformed, the swell tube 214 is deformed inwards by a deformation force transmitted from the oscillator head 310 to thereby press the elastic chip 220. Thus, the center portion of the elastic chip 220 is deformed into such a curved shape with a protruding center portion.

The vibration of the oscillator 300 and the deformation of the elastic chip 220 take place in a longitudinal direction of the hydraulic power unit 1. Thus, the capacity of the elastic tube 114 within the hydraulic tube 100 is changed, thereby extruding a fluid filled in the inner hollow 118 within the elastic tube 114 to the outside through the opening 132 which is formed in the connection jig 130.

Meanwhile, the extruded fluid passes through a predetermined path and a fluid chamber. Then, the fluid changes its direction to flow into the above-mentioned outer hollow 116, which will be described below.

Meanwhile, the elastic chip 220 receives a pressing force from the vibration rod 230 and is disposed between the vibration rods 230, and thus, the elastic chip 220 maintains its flat shape in an initial state where no external force is applied thereto from the oscillator 300.

Meanwhile, as described above, not only one elastic chip 220 but also a plurality of the elastic chips 220 may be stacked on each other.

Thus, when seen from a longitudinal direction of the hydraulic power unit 1, a hole formed in the elastic chip 220 may be wholly or partially covered other of the elastic chips 220. At this time, as illustrated in FIG. 6, the elastic chips 220 may be stacked in such a manner that curved surfaces thereof are curved in the same direction or in a direction in which they face each other, but the present invention is not limited thereto.

When the hydraulic power unit 1 according to the present invention and all members that are internally or externally connected thereto are filled with a fluid and sealed, the fluid within the sealed space may be circulated in a desired direction.

In order to increase an amount and a force of the fluid which is extruded through the opening 132, a deformation amount of the oscillator 300 is required to be increased. A method of increasing the deformation amount of the oscillator 300 may be classified into a method of increasing a voltage of electric energy to be applied and a method of mechanically stacking a plurality of piezoelectric elements used as the oscillator 300.

In addition, as described above, the amplitude amplification device 200 is disposed between the oscillator 300 and the hydraulic tube 100, and thus, an amount of fluid which is extruded and inpoured through an extrusion passage 434 and an amount of fluid which is extruded and inpoured through an inlet may be increased, thereby further increasing the output of the hydraulic power unit 1.

Hereinafter, the hydraulic engine 2 including the hydraulic power unit 1 according to the present invention will be described.

Figure 11:
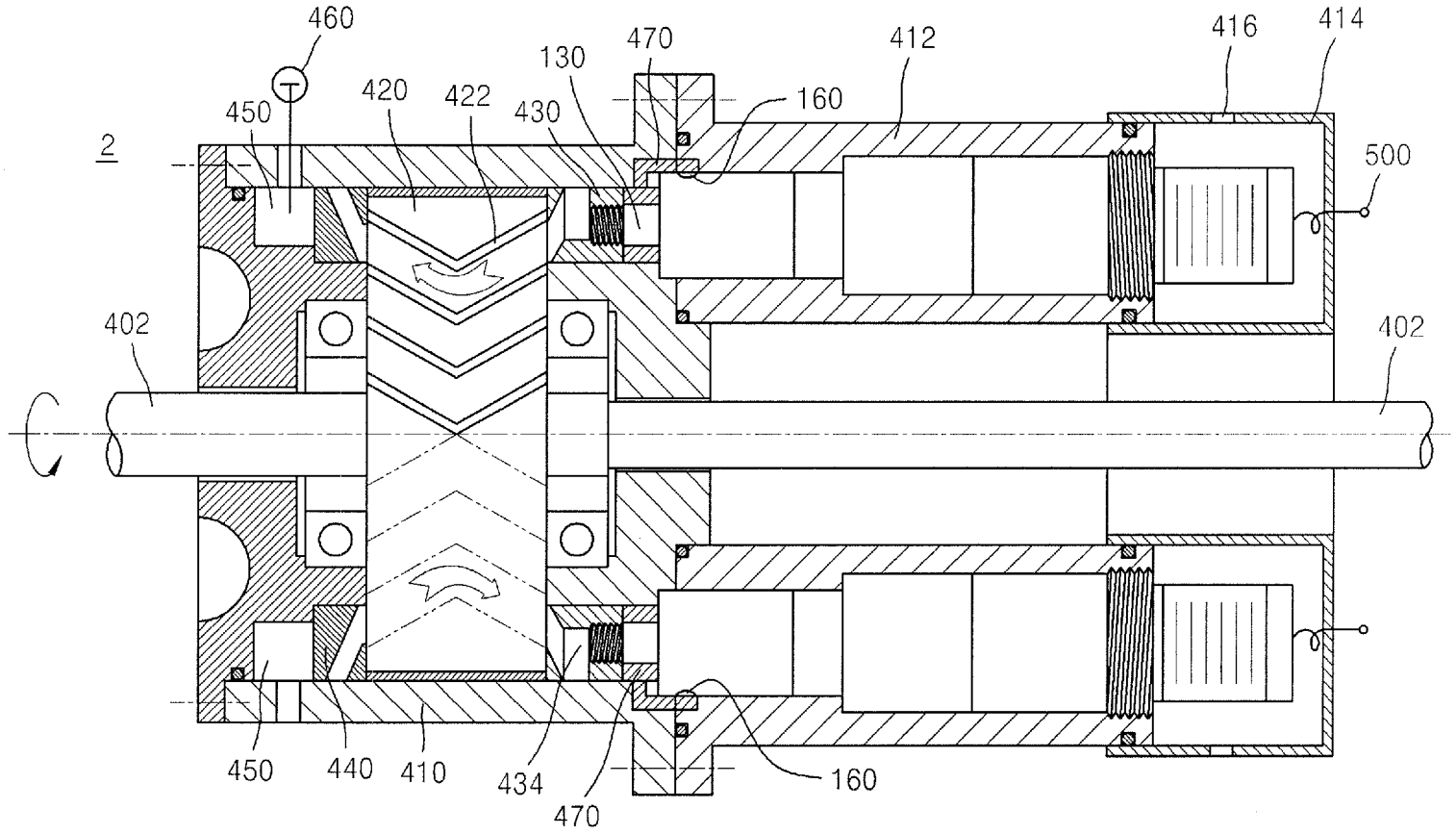
FIG. 11 is a diagram illustrating the hydraulic engine according to the embodiment of the present invention.
Figure 12:
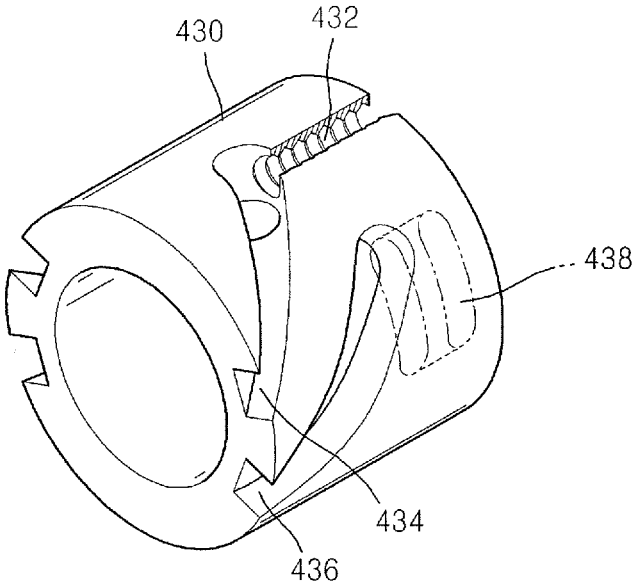
FIG. 12 is a diagram illustrating a rear flange of the hydraulic engine according to the embodiment of the present invention.
Figure 13:
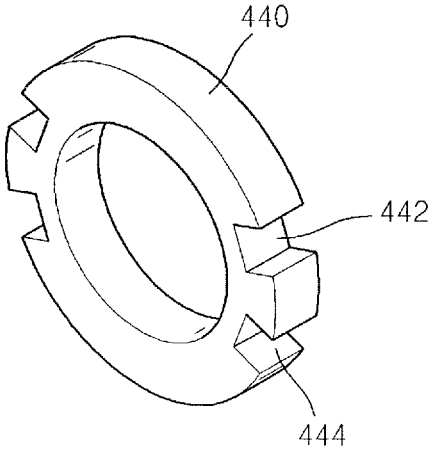
FIG. 13 is a diagram illustrating a front flange of the hydraulic engine according to the embodiment of the present invention.

FIG. 11 is a diagram illustrating the hydraulic engine 2 including the hydraulic power unit 1 according to the embodiment of the present invention. FIG. 12 is a diagram illustrating a rear flange 430 of the hydraulic engine 2 according to the embodiment of the present invention. FIG. 13 is a diagram illustrating a front flange 440 of the hydraulic engine 2 according to the embodiment of the present invention. FIG.

Figure 15:
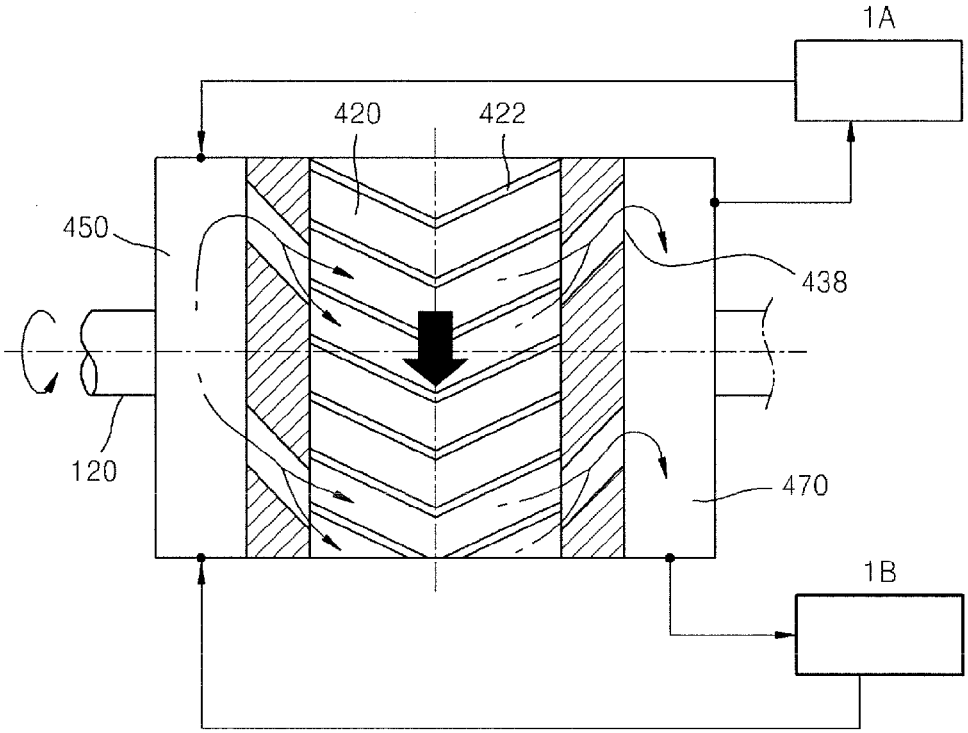
FIG. 15 is a diagram illustrating the whole hydraulic flow of a working fluid of the hydraulic engine according to the embodiment of the present invention.

14 is a diagram illustrating a flow of a working fluid of the hydraulic engine 2 according to the embodiment of the present invention. FIG. 15 is a diagram illustrating a state where the whole hydraulic force of a working fluid is balanced.

The hydraulic engine 2 according to the present invention includes the hydraulic power unit 1, a housing, a rotor 420 that is rotatably supported within the housing and is provided with a rotor blade 422 on the circumference thereof, a fluid chamber 450 which is disposed within the housing, and a flange.

The flange includes the front flange 440 and the rear flange 430, and a rotor is disposed between the front flange 440 and the rear flange 430.

The rear flange 430 includes a fixation hole 432 for fixing the hydraulic power unit 1, and an extrusion passage 434. The extrusion passage 434 is formed so that the rotor blade 422 formed in the rotor and the inner hollow 118 of the hydraulic tube 100 included in the hydraulic power unit 1 communicate with each other.

The front flange 440 includes a discharge hole 442 for discharging a fluid which is inpoured through the rotor blade 422, and the fluid chamber 450 disposed in front of the front flange 440.

The housing is a member constituting an outer shape of the hydraulic engine 2 according to the current embodiment of the present invention. The rotor 420 and a plurality of the hydraulic power units 1 may be disposed within the housing.

The rotor 420 is a member which is rotatably disposed within the housing. The rotor 420 includes a plurality of the rotor blades 422 that protrude in a direction of the radius of the rotor 420 with respect to a rotation axis of the rotor 420. Meanwhile, the rotor 420 may have a predetermined configuration of, for example, a predetermined double helical gear.

The output axis 402 may extend from the rotation axis of the rotor 420 within a flange or may be formed integrally with the rotation axis of the rotor 420. The output axis 402 may be installed so as to protrude to the outside from the housing.

Meanwhile, the housing may be divided into an upper housing 410 and a lower housing 412. A sealing member is disposed between the upper housing 410 and the lower housing 412 so as to prevent the fluid from leaking.

FIGS. 12 and 13 illustrate a flange. Referring to FIGS. 12 and 13, the flange forms a frame of the hydraulic engine 2 and may keep the hydraulic power unit in a constant position.

The flange includes the front flange 440 and the rear flange 430. The front flange 440 and the rear flange 430 are disposed within the housing, and the rotor 420 is disposed between the front flange 440 and the rear flange 430.

The front flange 440 and the rear flange 430 are formed in the form of a ring. That is, as illustrated in FIGS. 12 and 13, the front flange 440 and the rear flange 430 are formed in the form of a ring in which a hollow is formed therein.

The hydraulic power unit 1 is fixed to the rear flange 430. The rear flange 430 includes the predetermined fixation hole 432. A female screw portion is formed in the fixation hole 432 so as to be coupled with a male screw portion formed in the connection jig 130. At this time, a plurality of the fixation holes 432 may be formed, and the hydraulic power unit 1 may be fixed to the fixation hole 432.

The extrusion passage 434 is formed in the rear flange 430, and the extrusion passage 434 is connected to the fixation hole 432. The extrusion passage 434 is disposed between the rotor 420 and the hydraulic tube 100. A fluid extruded from the inner hollow 118 within the hydraulic tube 100 may be transmitted to the rotor 420 through the extrusion passage 434. Preferably, the extrusion passage 434 forms a tilt angle with respect to the rotor blade 422 so that the fluid extruded from the hydraulic tube 100 applies an extrusion force to the rotor blade 422 to thereby rotate the rotor 420. That is, the fluid extruded through the hydraulic tube 100 applies an extrusion force to the rotor blade 422 to thereby rotate the rotor 420, thereby generating power. The injection chamber passage 438 is formed in the rear flange 430. The injection chamber passage 438 is connected to the injection passage 436. A fluid transmitted from the rotor 420 may be injected into the side through hole 160 through the injection chamber passage 438 and the injection passage 436. A fluid extruded from the extrusion passage 434 may rotate the rotor 420. Thereafter, the fluid passes through the discharge hole 442 and be transmitted to the fluid chamber 450. Thereafter, the fluid changes its direction and passes through the discharge hole 444 and the injection passage 436. And a fluid may be injected into the side through hole 160 connected to the injection chamber passage 438 and the rear fluid chamber 470.

The discharge hole 442 is formed in the front flange 440, and the fluid chamber 450 is formed in front of the front flange 440. The fluid extruded through the extrusion passage 434 applies an extrusion force to the rotor blade 422 to thereby rotate the rotor 420. Then, the fluid passes through the fluid chamber 450 and changes its direction to thereby rotate the rotational rotor 420 again. Similarly to the extrusion passage 434, the discharge hole 442 may have a tilt angle.

At this time, the discharge hole 442 formed in the front flange 440 and the side through hole 160 formed in the metal tube 112 of the hydraulic tube 100 are connected to each other through the fluid chamber 450, and thus, a flowing path along which the fluid flows is formed. That is, the discharge hole 442 formed in the front flange 440 is configured in such a manner that an extrusion fluid, which flows through the side through hole 160 formed in the metal tube 112 to thereby rotate the rotor 420, applies rotatory power to the rotational rotor 420 through the fluid chamber 450 and a fluid movement path so as to flow into the outer hollow 116 through the side through hole 160. Thus, the fluid extruded from the inner hollow 118 may rotate the rotor 420 and then flow into the outer hollow 116. Therefore, the fluid may be extruded to the inside or outside of the hydraulic tube 100, and the extrusion and inpouring of the fluid with respect to the hydraulic tube 100 may be bidirectionally performed at the same time, thereby rotating the rotor 420 in one direction. Meanwhile, the predetermined fluid chamber 450 having the working fluid gathered therein may be included in the fluid movement path of the outer hollow 116.

Preferably, hydraulic power units 1 in an even number are installed within the hydraulic engine 2 so as to be associated with each other, and thus, the hydraulic power units 1 may replenish a balance force.

Figure 14:
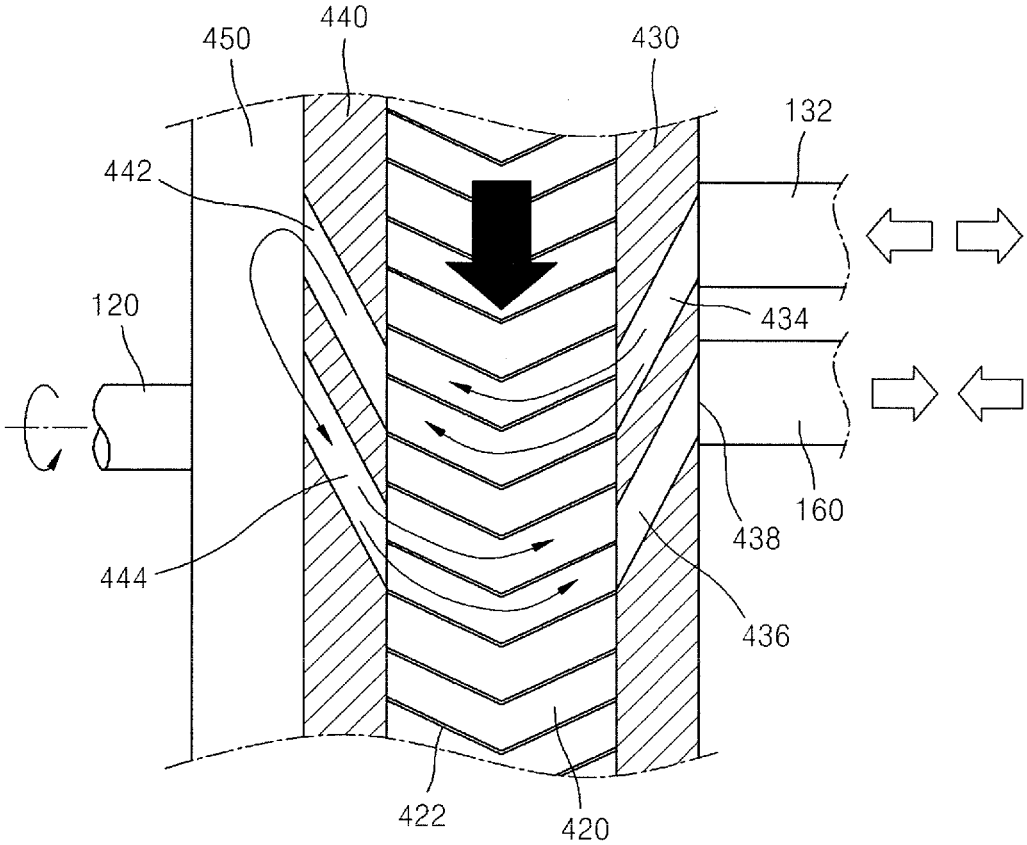
FIG. 14 is a diagram illustrating a flow of a working fluid of the hydraulic engine according to the embodiment of the present invention.

That is, as illustrated in FIG. 14, a first hydraulic power unit 1A and a second hydraulic power unit 1B may be disposed in one hydraulic engine 2. At this time, each hydraulic power unit 1 may be disposed in a circumferential direction of the rotor 420. A working fluid extruded from the first hydraulic power unit 1A may rotate the rotor 420, may be discharged to the fluid chamber 450 through the discharge hole 442, may change its direction through the fluid chamber 450, may rotate another rotor through another discharge hole 444, and then may be drawn into the first hydraulic power unit 1A through the side through hole 160, the injection chamber passage 438 and the injection passage 436.

The above-mentioned operation may be inversely repeated.

In addition, a complementary operation between fluids is performed between the first hydraulic power unit 1A and the second hydraulic power unit 1B through the fluid chamber 450 and the injection chamber passage 438, and rotatory power of the rotor may be constantly maintained during such a complementary operation between fluids.

As illustrated in FIG. 13, a force applied to a fluid may be constantly balanced by a complementary operation so that a strong forward driving force of the oscillator 300 of the even-numbered hydraulic power units 1A and a weak backward driving force of the oscillator 300 of the even-numbered hydraulic power unit 1B are combined with each other through a forward driving fluid that is extruded from the fluid chamber 450 and the injection chamber passage 438.

Meanwhile, a predetermined accumulator 460 may be provided in a fluid movement path between the discharge hole 442 and the side through hole 160. The accumulator 460 adjusts a flow rate of a fluid. The accumulator 460 may be configured to replenish a fluid when a flow rate of the fluid changes due to temperature, pressure, or loss of the fluid or to appropriately adjust a flow rate of the fluid.

The hydraulic power unit 1 extrudes and inpours a fluid in a tangential direction of one surface of the rotor 420 toward a plurality of the rotor blades 422 that are disposed in the rotor 420.

Preferably, the hydraulic engine 2 may further include an operational module 500 that drives the hydraulic power unit 1, adjusts a number of rotations and a torque of the rotor, and includes a secondary battery as a driving power source.

In the hydraulic engine 2 according to the present invention, an inverse piezoelectric effect is mainly used by the ceramic oscillator 300 that is included in the hydraulic power unit 1 constituting the hydraulic engine 2. Based on the inverse piezoelectric effect, a displacement and strong force occur in the ceramic oscillator 300 according to a driving voltage, a driving frequency, and stiffness (rigidity) of the ceramic oscillator 300. Since a working fluid to be extruded strongly presses the rotor blade 422 due to the displacement and strong force, a torque for rotating the rotor 420 may be extremely increased. In particular, a flow rate of the working fluid may be arbitrarily changed by adjusting a time to apply a driving signal.

Meanwhile, the hydraulic engine 2 according to the present invention does not require additional power or fuel except for power of a secondary battery included in a driving module, which is used to generate a signal to be applied to the ceramic oscillator 300 included in the hydraulic power unit 1. Accordingly, the hydraulic engine 2 may be continuously driven within a lifespan range of the ceramic oscillator 300 and a secondary battery for supplying power for applying a driving signal to the ceramic oscillator 300 without supplying additional power or fuel.

In addition, the hydraulic engine 2 according to the present invention includes an amplitude amplification device, and thus, a vibration amplitude according to the oscillator 300 may be further amplified. Accordingly, the hydraulic engine 2 may have a larger output.

As described above, according to the one or more of the above embodiments of the present invention, in a hydraulic engine, an inverse piezoelectric effect is mainly used in a ceramic oscillator included in a hydraulic power unit of the hydraulic engine. Based on the inverse piezoelectric effect, a displacement and strong force occur in the ceramic oscillator according to a driving voltage, a driving frequency, and stiffness (rigidity) of the ceramic oscillator. Since a working fluid to be extruded strongly presses a rotor blade due to the displacement and strong force, a torque for rotating a rotor may be extremely increased. In particular, a flow rate of the working fluid may be arbitrarily changed by adjusting a time to apply a driving signal.

Meanwhile, the hydraulic engine according to the present invention does not require additional power or fuel except for power of a secondary battery included in a driving module, which is used to generate a signal to be applied to the ceramic oscillator included in the hydraulic power unit. Accordingly, the hydraulic engine may be continuously driven within a lifespan range of the ceramic oscillator and a secondary battery for supplying power for applying a driving signal to the ceramic oscillator without supplying additional power or fuel.

In addition, the hydraulic engine according to the present invention includes an amplitude amplification device, and thus, a vibration amplitude according to an oscillator may be further amplified. Accordingly, the hydraulic engine may have a larger output.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims.

What is claimed is:

1. A hydraulic engine comprising:

a hydraulic power unit comprising a hydraulic tube comprising a hollow portion having an opened front end and being filled with a fluid, an amplitude amplification device that is disposed at a rear side of the hydraulic tube, an oscillator that is disposed at a rear side of the amplitude amplification device so as to be deformed and increases and decreases a pressure within the hydraulic tube, and an oscillator head that is attached to a front end of the oscillator, wherein the hydraulic tube extends in a longitudinal direction, comprises a metal tube formed on the outside thereof and an elastic tube formed on the inside thereof, and is configured in the form of a double tube having an outer hollow and an inner hollow, wherein the amplitude amplification device comprises a casing having a hollow formed therein, a swell tube that is disposed within the casing and has a cylindrical hollow therein, a plurality of vibration rods that are disposed in the hollow of the swell tube, and an elastic chip that is disposed in the hollow of the swell tube, intersects with the hollow, and is disposed between the plurality of vibration rods, wherein the oscillator moves bidirectionally and changes the pressure within the hydraulic tube by applying deformation force to the vibration rod according to its deformation so that the fluid within the hydraulic tube is extruded to the outside or flows into the hydraulic tube, wherein the hydraulic tube comprises a front position fixation holder and a rear position fixation holder that is disposed within the metal tube and comes into contact with a front side and a rear side, respectively, of the elastic tube, and a connection jig that is disposed at a front end of the metal tube and is disposed so as to come into contact with a front side of the front position fixation holder of the elastic tube, wherein the rear position fixation holder is disposed so as to come into contact via a seal ring with at least one vibration rod included in the amplitude amplification device, wherein at least a portion of the connection jig seals the outer hollow, wherein an opening is formed in at least a portion of the connection jig so as to cause the inner hollow to communicate with the outside, and wherein a side through hole is formed at one side of the metal tube so as to cause the outer hollow and the outside to communicate with each other.

2. The hydraulic engine of claim 1, wherein the oscillator is deformed in a direction toward the inside of the hollow portion of the hydraulic tube and in an opposite direction when electricity is applied thereto by an inverse piezoelectric effect.

3. The hydraulic engine of claim 1, wherein the hydraulic tube comprises a plurality of first elastic links, wherein the elastic tube is formed as a corrugated pipe having a plurality of corrugations extending in a longitudinal direction, wherein the first elastic link is disposed so as to come into contact with a concave portion of the corrugation and to extend in a longitudinal direction along the corrugation, and wherein one end of the first elastic link comes into contact with the connection jig through the rear front position fixation holder, the other end thereof comes into contact with the vibration rod through the position fixation holder, and the elastic tube is pressed in a horizontal direction according to a deformation force of the vibration rod.

4. The hydraulic engine of claim 3, wherein the first elastic link is formed by bending an elongated steel wire, wherein the first elastic link comprises first curved portions, which are both sides of the steel wire being bent inwards in a longitudinal direction, and second curved portions, which are both ends of the steel wire being bent and gathered together toward the center through the first curved portions, and wherein the second curved portion has a ring shape.

5. The hydraulic engine of claim 4, wherein a lower portion of the second curved portion comes into contact with at least a portion between the first curved portions.

6. The hydraulic engine of claim 1, further comprising:

a housing;

a rotor that is rotatably supported within the housing and has a rotor blade disposed on a circumference thereof; and a flange that is disposed within the housing, wherein the flange comprises a front flange and a rear flange, and the rotor is disposed between the front flange and the rear flange, wherein the rear flange comprises a fixation hole for fixing the hydraulic power unit and an extrusion passage, wherein the extrusion passage is configured to cause the rotor blade of the rotor and the inner hollow of a hydraulic tube included in the hydraulic power unit to communicate with each other, and wherein the front flange comprises a fluid chamber and a discharge hole so that a fluid inpoured through the rotor blade is bidirectionally discharged.

7. The hydraulic engine of claim 6, wherein the extrusion passage has a tilt angle with respect to the rotor blade so that the fluid extruded from the hydraulic tube applies an extrusion force to the rotor blade to thereby rotate the rotor.

8. The hydraulic engine of claim 7, wherein the fluid chamber and the discharge hole formed in the front flange and the side through hole formed in the metal tube of the hydraulic tube are connected to each other so that the fluid flows therebetween.

9. The hydraulic engine of claim 6, further comprising an operational module that drives the hydraulic power unit, adjusts a number of rotations and torque of the rotor, and comprises a secondary battery as a driving power source.

10. The hydraulic engine of claim 1, wherein the elastic chip is formed of a material having an elastic restoring force, the elastic chip having a form of a circular plate with a protruding central portion, and is provided with a plurality of holes formed along a circumference thereof.

11. The hydraulic engine of claim 10, wherein the holes are formed in a fan shape with a portion of the circumference of the elastic chip forming an arc thereof.

12. The hydraulic engine of claim 11, wherein the swell tube comprises a plurality of second elastic links that are disposed along a circumferential surface of the vibration rod.

13. The hydraulic engine of claim 12, wherein the second elastic link is formed by bending an elongated steel wire, wherein the second elastic link comprises first curved portions, which are both sides of the steel wire being bent inwards in a longitudinal direction, and second curved portions, which are both ends of the steel wire being bent and gathered together toward the center through the first curved portions, and wherein the second curved portion has a ring shape.

14. The hydraulic engine of claim 13, wherein a lower portion of the second curved portion comes into contact with at least a portion between the first curved portions.

15. The hydraulic engine of claim 14, wherein the elastic chip is disposed at a position overlapping a position at which the second curved portion is disposed.

* * * * *